United States Patent [19]

Feltz et al.

[11] Patent Number: 4,872,018

[45] Date of Patent: Oct. 3, 1989

[54] MULTIPLE LOOP ANTENNA

[75] Inventors: John F. Feltz, Fairborn; Michael F. Hartings, West Carrollton; Richard D. Heaton, Tipp City, all of Ohio

[73] Assignee: Monarch Marking Systems, Inc., Dayton, Ohio

[21] Appl. No.: 92,052

[22] Filed: Aug. 31, 1987

[51] Int. Cl.[4] ..... H01Q 7/04; G08B 13/22

[52] U.S. Cl. ..... 343/742; 343/842; 343/867; 340/572

[58] Field of Search ..... 343/742–744, 343/866–868, 870, 842; 340/572

[56] References Cited

U.S. PATENT DOCUMENTS

| | | | |
|---|---|---|---|
| 3,390,394 | 6/1968 | Glimvall | 343/742 |
| 4,251,808 | 2/1981 | Lichtblau | 343/842 |
| 4,260,990 | 4/1981 | Lichtblau | 343/742 |
| 4,334,227 | 6/1982 | Marks | 343/867 |
| 4,373,163 | 2/1983 | Vandebult | 343/842 |
| 4,633,250 | 12/1986 | Anderson et al. | 343/742 |
| 4,679,046 | 7/1987 | Curtis et al. | 343/867 |

*Primary Examiner*—Rolf Hille
*Assistant Examiner*—Michael C. Wimer
*Attorney, Agent, or Firm*—Mason, Kolehmainen, Rathburn & Wyss

[57] ABSTRACT

A multiple loop antenna particularly suitable for use with an electronic article surveillance security system for detecting the presence of a resonant tag employs first and second shielded twisted loops lying in a common plane and having portions thereof interleaves with each other. The loops are electrically coupled to each other and to a common transmitter or receiver. The loops may be fabricated from coaxial cable to achieve the shielding function at low cost while providing design flexibility.

29 Claims, 2 Drawing Sheets

Fig. 1
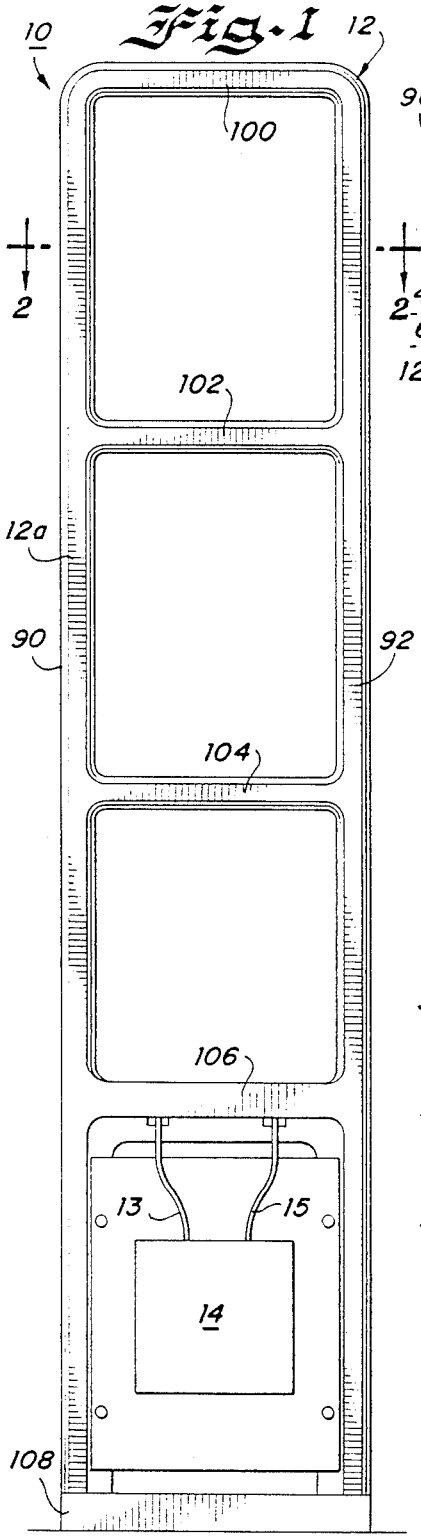
Fig. 2
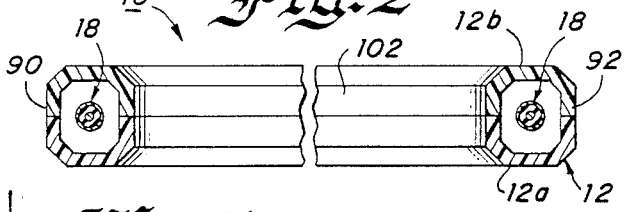
Fig. 7
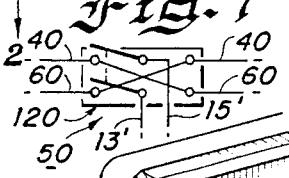
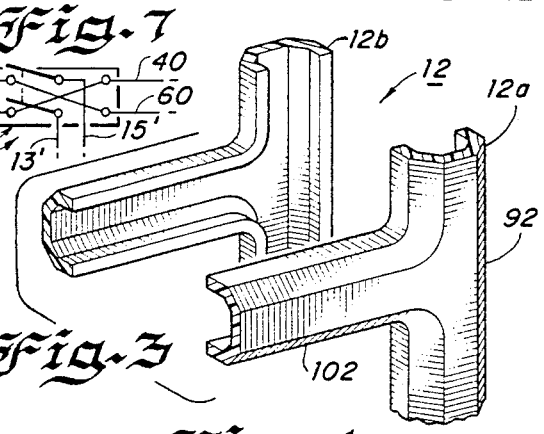
Fig. 3
Fig. 4
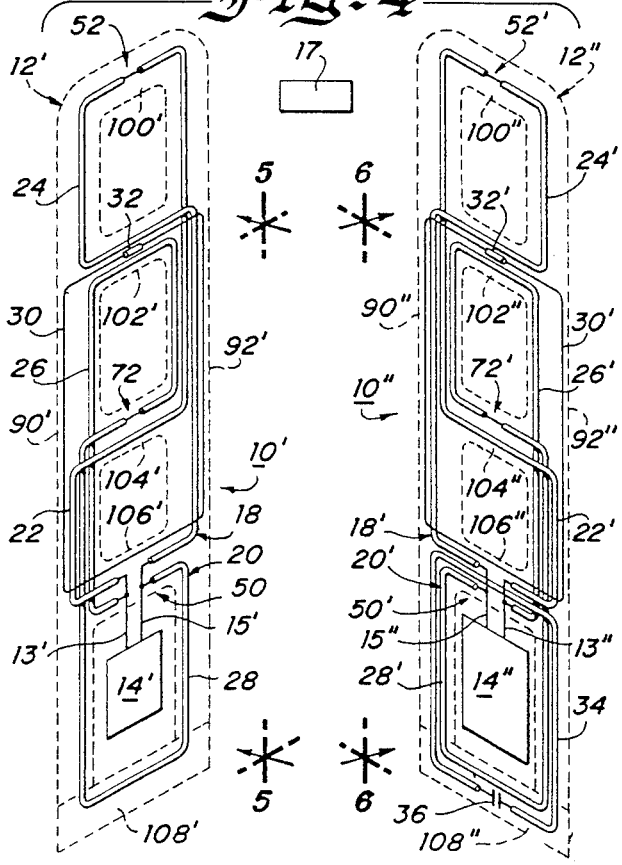

10'
12'
52
40
46
46
42
100'
24
90'
32
102'
92'
26
30
72
60
64
64
62
104'
22
106'
40
110
40
18
50
20
60
13'
15'
28
14'
108'
12"
52'
40'
46'
46'
42'
100"
90"
24'
102'
32'
92"
26'
30'
72'
60'
64'
64'
62'
104"
22'
106"
50'
40'
110'
40'
18'
20'
60'
15"
13"
14"
28'
34
36
108"

MULTIPLE LOOP ANTENNA

BACKGROUND OF THE INVENTION

1. Field of the Invention

This invention relates generally to antennas, and more particularly to antennas that are adapted for use with electronic article surveillance systems. In such systems the articles being protected are tagged with a tag containing a resonant circuit. A swept frequency interrogation transmitter whose frequency is swept through the resonant frequency of the resonant circuit contained in a tag has its output coupled to an antenna located near an exit from the protected area. A second antenna is disposed near the transmitting antenna. The second antenna is coupled to a receiver that detects a signal radiated by the tag whenever the transmitter frequency passes through the resonant frequency of the tag.

2. Description of the Prior Art

Various antennas usable for electronic article surveillance purposes are known. One such antenna is disclosed in U.S. Pat. No. 4,251,808. This patent discloses a twisted loop shielded antenna that employs a twisted loop having two or more sections shielded by a metal tube. The multiple loop sections are twisted so that they are in phase opposition, thereby confining the transmitted signal to an area close to the transmitter, and reducing the amount of signal radiated to areas outside the immediate vicinity of the transmitting antenna. Similarly, the phase opposition of the receiving antenna serve to cancel spurious signals received from distant sources. The shield is used to shield the antennas from capacitively coupled spurious electrical signals. However, while the antenna disclosed in the aforementioned U.S. Pat. No. 4,251,808 does operate as an effective magnetic antenna for an electronic article surveillance system, the antenna is relatively difficult and costly to fabricate and tends to be bulky.

SUMMARY OF THE INVENTION

Therefore, it is an object of the present invention to provide an improved antenna particularly suitable for use in electronic article surveillance systems.

It is another object of the invention to provide an antenna for use in an electronic article surveillance system that overcomes many of the disadvantages of the prior art antennas.

It is yet another object of the present invention to provide a high performance, low cost antenna particularly suitable for electronic article surveillance systems.

It is yet another object of the present invention to provide an improved twisted loop antenna whose performance characteristics may be readily changed electrically.

It is another object of the present invention to provide an antenna particularly usable for electronic article surveillance systems whose characteristics can be periodically changed electronically.

It is another object of the present invention to provide an antenna for electronic article surveillance system that is relatively easy to manufacture and whose characteristics are alterable by simple component changes.

It is another object of the present invention to provide a low cost esthetically attractive antenna for an electronic article surveillance system.

Briefly, the antenna according to the present invention utilizes two shielded twisted loops fabricated from coaxial cable. Each twisted loop contains two spaced loop sections that lie in a common plane and are positioned in phase opposition to each other. The two twisted loops are positioned in a common plane with the loop sections of the two twisted loops interleaved with each other. The two twisted loops may be connected in phase, in phase with a predetermined offset, in phase opposition, or by variable phase circuitry to achieve different antenna characteristics. The two twisted loops are carried in a rigid housing, preferably fabricated from a nonconductive material such as plastic, that supports the twisted loops, and which may be shaped to provide a variety of esthetic appearances. The rigid housings may be fabricated from two symmetrical halves to allow ease of assembly and reduced tooling costs.

BRIEF DESCRIPTION OF THE DRAWING

These and other objects and advantages of the present invention will become readily apparent upon consideration of the following detailed description and attached drawing, wherein:

FIG. 1 is an elevational view of the antenna according to the present invention, and shows the rigid support housing;

FIG. 2 is a sectional view taken along line 2—2 of FIG. 1 illustrating the position of the coaxial cable within the housing;

FIG. 3 is a partial exploded view of a portion of the housing showing the construction details of the housing;

FIG. 4 is a schematic illustration of two antennas according to the invention utilized at the checkout point of an electronic article surveillance system;

FIG. 6 is an illustration similar to FIG. 5 showing the antenna used in conjunction with an electronic article surveillance receiver; and FIG. 7 is a block diagram of an active phase shifter usable in conjunction with the present invention.

DETAILED DESCRIPTION

Figure 5:
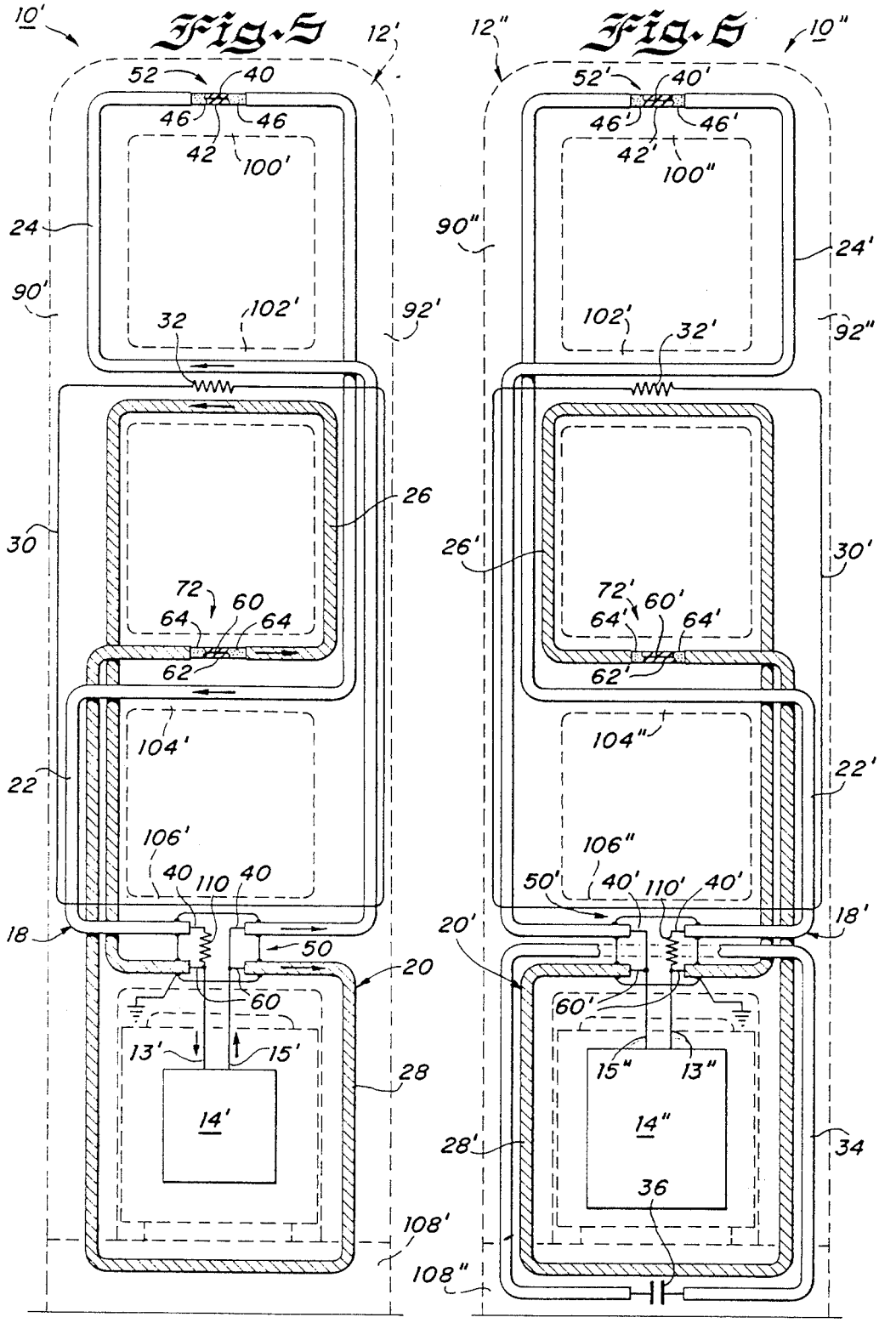
FIG. 5 is a schematic view of the antenna utilized in conjunction with an electronic article surveillance transmitter showing the construction of the electrical components of the antenna in greater detail.

Referring now to the drawing, with particular attention to FIG. 1, there is illustrated an antenna according to the invention generally designated by the reference numeral 10. The antenna 10 comprises a rigid supporting housing 12 that is formed from a pair of symmetrical halves 12*a* and 12*b* and supports the two interleaved twisted loops therein. A transmitter or receiver may be supported within a housing 14 contained within one loop of the antenna 10, preferably the lowest loop, and coupled to the twisted loop antenna via a pair of leads 13 and 15.

In a normal electronic article surveillance system, a pair of antennas 10 would be disposed at opposite sides of a doorway or other exit from a protected area. One of the antennas would be connected to a transmitter, for example, a swept frequency transmitter whose frequency is swept a predetermined amount, for example, plus or minus 10% about a predetermined center frequency. The articles being protected, for example, articles of clothing, would have attached thereto or concealed therein a resonant tag, comprising, for example, an inductance capacitance circuit tuned to a frequency within the swept range of frequencies of the transmitter. The second antenna would be connected to a receiver having a bandwidth capable of accommodating the range of frequencies transmitted by the transmitter and any signal generated by the tag. In the event of an attempted pilferage, the perpetrator would have to carry the tagged article between the transmitting and receiving antennas. During the period of time when the tag is in proximity to the two antennas, the tag will provide a distinct tag signal to the receiving antenna each time the signal transmitted by the transmitting antenna passes through the resonant frequency of the tag. This distinct tag signal will be received by the receiver and analyzed, and if found to be a valid tag signal, an alarm will be generated.

A typical arrangement for positioning a transmit antenna and a receive antenna at the exit of a protected area is illustrated in FIG. 4. FIG. 4 illustrates a pair of antennas 10' and 10" located at the exit of a protected area. FIG. 4 illustrates a transmitting antenna 10' having a housing 14' carrying a transmitter. Disposed opposite the transmitting antenna 10' is a receiving antenna 10" positioned in the exit substantially parallel to the transmitting antenna 10'. The receiving antenna 10" has a housing 14" that contains a receiver capable of receiving signals from the antenna 10' and from a tag 17. An example of a suitable transmitter and receiver usable in conjunction with the antennas 10' and 10" is disclosed in copending application Serial No. 07/091,423, filed Aug. 31, 1987, now U.S. Pat. No. 4,812,822, entitled "ELECTRONIC ARTICLE SURVEILLANCE SYSTEM UTILIZING SYNCHRONOUS INTEGRATION", filed concurrently herewith by John F. Feltz, John W. Taylor and Richard S. Vuketich. The transmitting antenna 10' contains a first shielded twisted loop 18 and a second twisted loop 20 each having two spaced apart loop sections forming a generally C-shaped loop configuration. The first twisted loop 18 has a first loop section 22 disposed near the housing 14' and a second loop section 24 disposed near the top of the rigid supporting structure 12'. The loop section 24 is twisted 180° with respect to the loop section 22 to put the loop sections 22 and 24 substantially into phase opposition, however, individual loops connected in phase opposition or by means of a suitable phase shift network may be used. The twisted loop 20 has an upper loop section 26 interposed between the loop sections 22 and 24 of the twisted loop 18. A second loop section 28 is disposed beneath the loop section 22 of the loop 18. The loop sections 26 and 28 are also twisted with respect to each other to provide phase opposition between the two loops. The loops 18 and 20 are preferably fabricated from coaxial cable and disposed in a coplanar relationship with respect to each other; however, they may be fabricated from unshielded conductors, particularly if the antenna is to be operated at low frequencies. A third loop 30 containing a resistor 32 surrounds the loop sections 22 and 26. The loop 30, whose function will be explained in a subsequent portion of the specification, may comprise either an unshielded conductor or a shielded conductor, for example, a section of coaxial cable. A similar loop 30' and resistor 32' surrounds the loop sections 22' and 26' of the antenna 10". In addition, a loop 34 containing a capacitor 36 surrounds the housing 14" containing the receiver. The loop 34 may also be fabricated from a shielded or an unshielded conductor. Also, while resistors and capacitors are discussed above, various other lumped circuit and phase element shifting and impedance matching networks may be used.

Referring to FIGS. 5 and 6, which show the antennas 10' and 10" in greater detail, the coaxial cable forming the loop 18 includes a central conductor 40 surrounded by insulation 42 and shielded by a shield 46 (FIG. 5). The central conductor is connected to the transmitter within the housing 14' through a phase shift network 50 whose function will be described in a subsequent portion of the specification. A gap 52 is provided within the shield 46 at a point opposite the phase shift network 50, which may comprise any suitable active or passive phase shift network or impedance matching network that gives the desired antenna pattern. If desired, the pattern may be made time varying by using a phase shift network whose characteristics vary with time. Preferably, the gap is positioned such that it is equidistant between the two ends of the cable connected to the phase shift network 50. The construction of the loop 20 is similar to that of the loop 18 with the coaxial cable forming the loop 20 having a central conductor 60, a layer of insulation 62, a shield 64 and a gap 72 within the shield 64 that bisects the shield so that the two sections of the shield between the gap 72 and the phase shift network 50 are equal in length. The loops 18' and 20' of the receiving antenna 10" are similar. The loop 18' is similar to the loop 18 in that it is fabricated from a coaxial cable having a central conductor 40', surrounding insulation 42', a shield 46' and a gap 52' in the shield 46'. Similarly, the loop 20' is comprised of a coaxial cable having a central connector 60', a shield 64' and a gap 72' in the shield 64'. A loop 30' and a resistor 32' similar to the respective loop and resistor 30 and 32 of the antenna 10' are utilized in the antenna 10".

The function of the shield around the various loops is to make the antenna operate as a magnetic or Faraday antenna. By providing a shield, preferably a grounded shield, about the various twisted loops of the antenna, the antenna is effectively shielded from electric fields. This is advantageous in an electronic article surveillance system because electric fields are less likely to cause interference with the signal received from the tag. Also, when utilizing a magnetic field antenna as a transmitting antenna, the field is confined to the immediate area of the system, and is less likely to cause interference with other electronic equipment in the vicinity. The gaps in the various loops serve to prevent induced currents from circulating in the shields.

The design of the present antenna permits a variety of variations in the basic antenna design to be implemented. For example, the antenna may be fabricated from a standard cable such as, for example, an RG-62 coaxial cable. The RG-62 cable utilizes a #22 gauge central conductor that gives the cable a resistance of approximately 16 ohms per thousand feet and a capacitance of approximately 13.5 picofarads per foot. However, in order to provide a broader band antenna, it would be advisable to increase the resistance of the central conductor while reducing the capacitance of the cable. Thus, by simply utilizing an RG-62 type cable having a #33 gauge central conductor instead of the standard #22 gauge central conductor, the resistance is increased to approximately 164 ohms per thousand feet and the capacitance is reduced to approximately 7.5 picofarads per foot. Going one step farther and utilizing a high resistance material for the wire further increases the resistance and the bandwidth. For example, a #33 gauge wire fabricated from nichrome has a resistance of approximately 13 ohms per foot, substantially higher than that of copper.

In an electronic article surveillance system, it is desirable to make the height of the antennas approximately equal to the height of a doorway and to have the pattern of the antennas such that the transmitted field is evenly distributed along the height of the transmitting antenna and the sensitivity of the receiving antenna is evenly distributed along its height. An antenna having multiple loop sections is advantageous in achieving this concept. In the antenna according to the invention, the various loops of cable are carried within two upright portions 90 and 92 of the rigid housing 12, in four cross members 100, 102, 104 and 106, and within a channel formed within a base 108. The upright members 90 and 92, the cross members 100, 102, 104 and 106 and the base 108 correspond to like numbered components in FIGS. 5 and 6, except the like numbered components in FIGS. 5 and 6 are identified with primed and double-primed numbers, respectively. Referring to FIG. 5, it is noted that the central conductors 40 and 60 of the loops 18 and 20 respectively, are connected together and to a lead 15' from the transmitter within the housing 14'. The opposite ends of the conductors 40 and 60 are connected to each other by means of a resistor 110, whose function will be later discussed. The central conductor 60 of the cable 20 is also connected to the transmitter within the housing 14' by a lead 13'. Assume for purposes of this discussion, that the value of the resistor 110 is low enough that it can be considered to be virtually a direct connection between the central conductors 40 and 60. Under these conditions, the two ends of the loops 18 and 20 are essentially connected to each other in phase. If we further assume that the instantaneous current flowing through the leads 13' and 15' is in the direction shown by the arrows adjacent to the leads 13' and 15', then the currents flowing through the portions of the loops 18 and 20 contained within the cross member 106' are in phase as is illustrated by the arrows adjacent the cables in the cross member 106'. The currents through the sections of the cable passing through the cross member 102' are also in phase as indicated by the arrows, while the currents flowing through the sections of the cables within the cross member 104' flow in opposite direction as indicated by the arrows. Thus, the fields produced by the sections of the cables within the cross members 102' and 106' reinforce each other while the fields produced by the sections of the cable within the cross member 104' cancel. This causes the antenna to produce a field pattern similar to that of an antenna having three loop sections, namely a large central loop (bounded by the cross members 102' and 106' and the uprights members 90' and 92'), and smaller upper and lower loops. If the connections of one of the loops 18 and 20 were reversed so that the ends of the loops 18 and 20 would be driven out of phase in a manner causing the currents in the cables within the cross member 106' to flow in opposite directions, then the currents in the sections of the cables within the cross member 102' would also flow in opposite directions, and the currents in the sections of the cable within the cross member 104' would flow in the same direction. Thus, the fields produced by the sections of the cables within the cross member 104' would aid whereas the fields produced by the sections of the cables within the cross members 102' and 106' would cancel. Consequently, the pattern of the antenna would be similar to that of a simple twisted loop antenna having two loops with an upper loop defined by the cross members 100' and 104' and the upright members 90 and 92', and the lower loop being defined by the cross members 104', the base 108' and the uprights 90' and 92'. Thus it is apparent that a substantial change in the pattern of the antenna may be effected by simply switching two leads.

It is possible to introduce phase shift other than 180° between the loops 18 and 20. This is accomplished by varying the value of the resistor 110 in order to adjust the amount of drive applied to the loop 18 and also to effect some phase shift between the loops 18 and 20. In practice, 100 ohms has been found to be a good value for the resistance of the resistor 110. Also, more complex phase shifting networks 50 may be interposed between the transmitter 14' and the loops 18 and 20. Similarly, various types of phase shifting networks 50' may be interposed between the receiver 14'' and the cables 18' and 20' (FIG. 6).

The loop 30 and resistor 32 (FIG. 5) also serve to make the field produced by the antenna 10' more uniform. The loop 30 acts as an air core transformer and serves to reduce the field intensity near the center of the antenna. The resistor 32 adjusts the influence of the loop 30 on the central loop sections of the antenna 10. The loop 30 may be an unshielded loop as shown in FIG. 5 or may be a shielded coaxial cable with the shield being either grounded or ungrounded. A value on the order of 100–300 ohms has been found to be a good value for the resistor 30, and it has been found advantageous to utilize a similar loop 30' and resistor 32' in the receiving antenna 10'' (FIG. 6).

The antenna of the present invention carries transmitting or receiving circuitry within a housing supported by the antenna. Metal components utilized in the transmitter or receiver or its housing may effect the field produced by the antenna. This has been found to be particularly the case in the receiving antenna because the receiver is larger than the transmitter, and thus has a greater effect on the field pattern. The loop 34 and capacitor 36 serve to correct the perturbations caused by the housing 14''. The loop 34 may be either a shielded cable as shown, or an unshielded loop, and the value of the capacitor 36 adjusted to correct for the amount of perturbation caused by the housing 14''. It has been found that a value on the order of less than 100 picofarads provides a suitable correction.

Because the field pattern produced by the antenna may be readily altered, it is possible to alter the field produced by the antenna on a dynamic basis utilizing active circuitry to alter the phase of signals applied to the two loops. For example, by utilizing a solid state double pole, double throw switch as the phase shift network 50 (FIG. 7) between the transmitter and the loops 18 and 20, the phase relationship between the loops 18 and 20 may be altered as a function of time to change the pattern of the transmitting antenna 10' between a three loop and a two loop pattern. Although the phase shift network 120 is illustrated as a simple double pole, double throw switch for purposes of illustration in FIG. 7, it should be understood that various active devices could be used to shift the phase by 180° or by other phase shifts, either continuously or in steps, in a periodic fashion. Alternating between a two loop and a three loop pattern has the advantage that a three loop pattern may cover an area not covered by the two loop pattern and vice versa. A similar double pole, double throw switch or other device may be employed between the receiver and the two loops 18' and 20' of the receiving antenna 10'' to periodically change the pattern of the receiving antenna 10'' from a three loop to a two loop pattern or to another pattern. Although not necessary, it may be desirable to switch the polarities of the transmitting antenna 10'' and the receiving antenna 10'' in synchronism.

Obviously, many modifications and variations of the present invention are possible in light of the above teachings. Thus, it is to be understood that, within the scope of the appended claims, the invention may be practiced otherwise than as specifically described above. For example, the antenna according to the invention may find other applications, for example, access control. Also, while a dual twisted loop embodiment of the antenna has been disclosed above, it should be understood that various combinations of twisted and untwisted loops are possible.

What is claimed and desired to be secured by Letters Patent of the United States is:

1. An antenna, comprising:

a first shielded twisted loop having first and second spaced apart loop sections lying in a substantially common plane and twisted substantially 180° with respect to each other;

a second shielded twisted loop having third and fourth spaced apart loop sections twisted substantially 180 with respect to each other, said third and fourth loop sections lying in substantially the same plane as said first and second loop section, said second loop section being interposed between said third and fourth loop sections and said third loop section being interposed between said first and second loop sections along said common plane wherein said first and second loops are fabricated from coaxial cable; and means electrically coupling said first and second twisted loops.

2. An antenna as recited in claim 1 wherein said coupling means includes means for altering the phase relationship between said first and second shielded twisted loops.

3. An antenna as recited in claim 2 wherein said phase altering means includes a resistor.

4. An antenna as recited in claim 2 wherein said phase altering means includes means for changing the phase relationship between said first and second twisted loops as a function of time.

5. An antenna as recited in claim 1 wherein the coaxial cable forming each of said twisted loops has a shield, and wherein each shield has a gap formed therein.

6. An antenna as recited in claim 1 wherein said coaxial cable has a central conductor formed of a resistive material.

7. An antenna as recited in claim 1 further including a rigid support supporting said cables.

8. An antenna as recited in claim 7 wherein said rigid support surrounds said coaxial cable.

9. An antenna as recited in claim 8 wherein said rigid support is fabricated from a nonconductive material.

10. An antenna as recited in claim 7 wherein said support is fabricated from two symmetrical half portions.

11. An antenna as recited in claim 1 further including means including a third loop surrounding a portion of each of said first and second twisted loops for altering the pattern of the antenna.

12. An antenna as recited in claim 11 wherein said pattern altering means includes a fourth loop surrounding a portion of one of said first and second loops.

13. An antenna for use in an electronic article surveillance system, comprising:

a first twisted loop having first and second spaced apart loop sections lying in a substantially common plane and twisted substantially 180° with respect to each other;

a second twisted loop having third and fourth spaced apart loop sections twisted substantially 180° with respect to each other, said third and fourth loop sections lying in substantially the same plane as said first and second loop sections, said second loop section being interposed between said third and fourth loop sections and said third loop section being interposed between said first and second loop sections wherein said first and second loop are fabricated from coaxial cable; and means electrically coupling said first and second twisted loops.

14. An antenna as recited in claim 13 wherein said coupling means includes a phase shift network.

15. An antenna as recited in claim 14 wherein said phase shift network includes means for changing the phase relationship between said first and second twisted loops as a function of time.

16. An antenna as recited in claim 13 further including a rigid support supporting said loops.

17. An antenna as recited in claim 16 wherein said rigid support surrounds said loops.

18. An antenna as recited in claim 17 wherein said rigid support is fabricated from a nonconductive material.

19. An antenna as recited in claim 13 further including means including a third loop surrounding a portion of each of said first and second twisted loops for altering the pattern of the antenna.

20. An antenna as recited in claim 19 wherein said third loop includes a lumped impedance element.

21. An antenna as recited in claim 13 further including means including a third loop disposed adjacent a portion of one of said first and second loops for altering the pattern of the antenna.

22. An antenna as recited in claim 21 wherein said third loop includes a lumped impedance element.

23. An antenna for use in an electronic article surveillance system, comprising:

a rigid supporting structure having a pair of spaced apart hollow vertical supporting members and a plurality of spaced apart hollow horizontal supporting members interconnecting said vertical supporting members, said vertical and horizontal supporting members being disposed in a substantially coplanar relationship and cooperating to form a plurality of adjacent loop supporting structures;

a first twisted loop having first and second spaced apart loop sections lying in a substantially common plane and twisted substantially 180° with respect to each other, said first twisted loop being fabricated from coaxial cable, said cable being contained within said supporting structure, with said first and second loop sections being contained within non-adjacent ones of said loop supporting structures; and a second twisted loop having third and fourth spaced apart loop sections twisted substantially 180° with respect to each other, said third and fourth loop sections lying in substantially the same plane as said first and second loop sections, one of said third and fourth loop sections being interposed between said first and second loop sections and one of said first and second loop sections being disposed between said third and fourth loop sections along said common plane, said second twisted loop being fabricated from a second coaxial cable contained within said supporting structure, with said third and fourth loop sections being contained within other non-adjacent ones of said loop supporting structures that are disposed adjacent the loop supporting structures containing the first and second loop sections.

24. An antenna for use in an electronic article surveillance systems, comprising:

a rigid supporting structure having a pair of spaced apart hollow vertical supporting members and a plurality of spaced apart hollow horizontal supporting members interconnecting said vertical supporting members, said vertical and horizontal supporting members being disposed in a substantially coplanar relationship and cooperating to form a plurality of adjacent loop supporting structures;

a first loop fabricated from coaxial cable, said cable being contained within said supporting structure, with said first loop being contained within one of said loop supporting structures;

a second loop fabricated from a second coaxial cable contained within said supporting structure, with said second loop being contained within another one of said loop supporting structures adjacent to the loop supporting structure containing the first loop;

means coupled to said first and second loops for effecting a phase shift therebetween; and a third loop fabricated from a third coaxial cable contained within said supporting structure with said third loop being contained within a third one of said loop supporting structures adjacent to one of the loop supporting structures supporting one of the first and second loops and coupled to said phase shift effecting means.

25. An antenna as recited in claim 24 wherein said first, second and third loops have substantially the same area.

26. An antenna for use near an exit of an area protected by an electronic article surveillance system, said antenna having only four loop sections disposed in a single vertical array of single loop sections disposed from top to bottom in a substantially common plane, said four loop sections including a first loop section disposed at the top of the array, a second loop section disposed immediately below said first loop section, a third loop section disposed immediately below said second loop section and a fourth loop section disposed at the bottom of said array immediately below said third loop section, a first twisted loop having portions thereof twisted substantially 180° with respect to each other and forming said first and third loop sections, a second twisted loop having portions thereof twisted substantially 180° with respect to each other to form said second and fourth loop sections, and means interconnecting said first and second twisted loops for continuously providing a predetermined phase shift therebetween.

27. An antenna as recited in claim 26 further including a rectangular loop enclosing said second and third loop sections.

28. An antenna for use near an exit of an area protected by an electronic article surveillance system, said antenna having first and second twisted loops, each of said twisted loops being twisted only once and cooperating to form first, second, third and fourth loop sections disposed in a vertical, substantially coplanar array of single loop sections, said first loop section being disposed at the top of the array, said fourth loop section being disposed at the bottom of the array, said second loop section being disposed immediately below said first loop section and said third loop section being interposed between said second and fourth loop sections, said first twisted loop being twisted 180° to form said first and third loops sections, said second twisted loop being twisted to form said second and fourth loop sections, means for providing an electric shield for said first and second twisted loops and phase shift means continuously maintaining a predetermined phase shift between said first and second loops.

29. An antenna as recited in claim 28 further including a rectangular loop enclosing said second and third loop sections.

* * * * *